US011254471B2

(12) United States Patent
Forman et al.

(10) Patent No.: US 11,254,471 B2
(45) Date of Patent: Feb. 22, 2022

(54) TAMPER-EVIDENT, TEAR-OPEN RESEALABLE PACKAGE

(71) Applicants: Josephine Anne Forman, Gilbertsville, PA (US); Rachel Conrad, Gilbertsville, PA (US); Joseph Corcoran, Conshohocken, PA (US); Jacob Greth, West Lawn, PA (US); Lisa Oberholtzer, East Greenville, PA (US); Paul Nedwick, Landsdale, PA (US)

(72) Inventors: Josephine Anne Forman, Gilbertsville, PA (US); Rachel Conrad, Gilbertsville, PA (US); Joseph Corcoran, Conshohocken, PA (US); Jacob Greth, West Lawn, PA (US); Lisa Oberholtzer, East Greenville, PA (US); Paul Nedwick, Landsdale, PA (US)

( * ) Notice: Subject to any disclaimer, the term of this patent is extended or adjusted under 35 U.S.C. 154(b) by 0 days.

(21) Appl. No.: 15/696,492

(22) Filed: Sep. 6, 2017

(65) Prior Publication Data

US 2019/0071221 A1 Mar. 7, 2019

(51) Int. Cl.

| | |
|---|---|
| ***B65D 33/34*** | (2006.01) |
| ***B65D 77/30*** | (2006.01) |
| ***B65D 33/20*** | (2006.01) |
| ***B65D 33/00*** | (2006.01) |
| ***B65D 33/16*** | (2006.01) |

(52) U.S. Cl.

CPC ..... *B65D 33/34* (2013.01); *B65D 33/004* (2013.01); *B65D 33/1691* (2013.01); *B65D 33/20* (2013.01); *B65D 77/30* (2013.01)

(58) Field of Classification Search

USPC ..... 383/5; 206/457, 807

See application file for complete search history.

(56) References Cited

U.S. PATENT DOCUMENTS

| | | | | |
|---|---|---|---|---|
| 2,285,542 A * | 6/1942 | Tasker | B65D 75/5833 | 229/237 |
| 2,967,010 A * | 1/1961 | Cuffey, Jr. | B65D 5/54 | 428/43 |
| 3,727,828 A * | 4/1973 | Hall | B65D 75/5827 | 229/87.05 |
| 3,863,834 A * | 2/1975 | Sandford | B65D 5/4266 | 229/205 |

(Continued)

*Primary Examiner* — Jacob K Ackun

(74) *Attorney, Agent, or Firm* — Ryder, Mazzeo & Konieczny LLC; Joseph M. Konieczny, Sr.; Gregory J. Gore

(57) ABSTRACT

A tamper-evident package utilizes a transparent resealable adhesive structure such as a tape or a label to cover the closure opening. Upon a first opening of the package frangible portions of the package front between adjacent arcuate cuts and slits defining the opening are torn. This tearing distorts the packaging film so that re-registration of the opposing lateral edges upon reclosing is not possible. This results in a package which is visually tamper-evident. The tamper-evident condition can be enhanced by graphics or other printing on the front of the package in the area of the closure to make the misalignment of a resealed closure viewed through the transparent structure more visually apparent. In one embodiment of the invention a series of arcuate cuts are centered laterally and are flanked on the right and left sides by two continuous wavy slits which form a portion of the closure opening.

13 Claims, 4 Drawing Sheets

(56) References Cited

U.S. PATENT DOCUMENTS

| | | | | | |
|---|---|---|---|---|---|
| 4,566,129 | A * | 1/1986 | McNamee | B65D 33/1691 | 206/806 |
| 4,572,377 | A * | 2/1986 | Beckett | B65D 75/5844 | 383/204 |
| 5,118,203 | A * | 6/1992 | Andronico | B65D 77/38 | 383/210 |
| 5,174,659 | A * | 12/1992 | Laske | B65D 33/20 | 383/207 |
| 5,725,311 | A * | 3/1998 | Ponsi | B65D 75/5838 | 206/494 |
| 9,493,285 | B2 * | 11/2016 | Krumme | B65D 75/566 | |
| 2005/0247764 | A1 * | 11/2005 | Sierra-Gomez | B65D 75/5838 | 229/87.08 |
| 2006/0066096 | A1 * | 3/2006 | Kan | B65D 33/20 | 283/101 |
| 2007/0275133 | A1 * | 11/2007 | Sierra-Gomez | B65D 75/44 | 426/122 |
| 2011/0038569 | A1 * | 2/2011 | Huffer | B65D 33/20 | 383/207 |
| 2011/0204056 | A1 * | 8/2011 | Veternik | B65D 75/5844 | 220/270 |
| 2014/0079343 | A1 * | 3/2014 | Lyzenga | B65B 61/182 | 383/203 |
| 2014/0376836 | A1 * | 12/2014 | Schieber | B65D 33/20 | 383/211 |
| 2015/0266626 | A1 * | 9/2015 | Forman | B65D 75/40 | 383/42 |
| 2016/0167860 | A1 * | 6/2016 | Tomsovic | B65D 75/5805 | 53/412 |
| 2017/0233158 | A1 * | 8/2017 | Lyzenga | B65B 61/182 | 53/415 |

* cited by examiner

TAMPER-EVIDENT, TEAR-OPEN RESEALABLE PACKAGE

FIELD OF THE INVENTION

The present invention relates to flexible packaging. More specifically it relates to tear-open bags or pouches which have tamper-evident resealable closures.

BACKGROUND OF THE INVENTION

Most often consumer food packages are made in such a way that for the consumer to access the product a tear strip at the top of the pack above the usual zipper or slider has to be torn off and thrown away. Because of the way these packages are made the bag material often tears unreliably and not straight. Sometimes it only tears part of the way and the leftover edges of film get in the way of the zipper or slider reclosing easily. Furthermore, consumers prefer not to be left holding a part of the package in their hands that requires disposal. The construction of these packages requires a heavier, thicker film material which adds to their cost.

While these packages have the advantage of being tamper evident because access can only be made after part of the bag has been permanently destroyed, the noted disadvantages are problems that the packaging industry still faces. Tear-open packages provide a solution because the torn material is visible, but when employed with more desirable lighter weight material they are most susceptible to tearing in unwanted directions. This is especially true when the tear force is initiated from the center of the package front downward which is the preferred opening location and direction.

Resealable packages that are not the tear-open type are not necessarily tamper evident because the parts of the package which are separated upon opening can be repositioned in registration with their original position so that a prior opening is not evident. An example of this construction is shown in U.S. Pat. No. 9,090,383 and is presented here as FIGS. 1 and 2. As seen in these figures a transparent tape 11 seals over a straight lateral opening slit 13. As the tape is pulled away, a package opening 17 occurs along the slit. A portion 15 of the tape 11 wraps around the sides of the package. When resealed the opposing edges of the opening realign so that tampering is not evident.

Other prior art packaging relevant to the present invention includes the following U.S. Pat. Nos. 3,570,751; 4,787,517; 5,746,369; 3,708,108; 2014/0216969; 2008/0240628; 2015/0266626 and U.S. Pat. No. 6,659,644.

There is therefore a need in the packaging arts for a resealable tamper-evident package of light weight film that has a central closure which tears open in a controlled, predictable manner and thus avoids the problems of the prior art cited above. It is further desired to devise such a package which is less expensive, easy to manufacture and which functions reliably.

SUMMARY OF THE INVENTION

The present package described in more detail below has been devised to solve the problems in consumer packaging as discussed above. One embodiment of the invention is a package having a front, a back, and top and bottom edges defining upward and downward longitudinal directions. The direction from one side edge to the other defines a lateral direction.

A tear-open closure having open and closed positions is located along a lateral closure axis for providing access to contents within the package through an opening through the closure when in the open position, said closure comprising two laterally extending longitudinally spaced rows of individual arcuate cuts and frangible portions located between adjacent cuts. Each cut is defined by a continuous arc with an apex and two free ends, a facing direction of each of said cuts is defined by the pointing direction of its apex. The cuts of one row all face in one vertical direction opposite the facing direction of all the cuts of the other row, said rows being longitudinally staggered thereby defining a series of laterally extending alternating upward pointing and then downward pointing unconnected cuts. In one embodiment the free ends of cuts in one row overlap laterally with the free ends in the other row. The free ends of all the cuts may intercept the lateral closure axis.

The package of the invention can be made resealable by using a transparent pressure sensitive adhesive tape or label to cover the closure when closed. Upon a first opening of the package, frangible portions of the package front between adjacent arcuate cuts are torn. This tearing distorts the packaging film so that re-registration of the opposing lateral edges upon resealing is not possible. This results in a package which is tamper-evident. The tamper-evident condition can be enhanced by graphics or other printing on the front of the package in the area of the closure to make the misalignment of a resealed closure viewed through the tape or label more visually apparent. In one embodiment of the invention the series of cuts are centered laterally and are flanked on the right and left sides by two continuous wavy slits which form side portions of the closure opening. Each of the wavy slits extend laterally to the package side edges along the opening axis from the series of arcuate cuts which occupy the central area of the closure.

The pressure sensitive adhesive tape or label is comprised of a backing and an adhesive on one side of the backing. Tape structures are commonly wound upon themselves placing the adhesive in contact with the reverse or uncoated side of the tape backing or silicone coated release paper and films to enable unwind and dispensing. Tape structures that do not use release liners commonly use differentials in surface energy and or chemical treatment to enable unwind and dispensing into the application. Examples include but are not limited to differentials in surface energy achieved through either flame or corona energy surface treatment or the application of release coatings such as the Escoat Product line of Mayzo Incorporated (Swanee Ga., USA) based on Based on polyvinyl octadecyl carbamate (PVODC) and polyvinyl stearyl carbamate (PVSC) chemistries. Labels are typically comprised of a silicone release liner which could be either filmic or paper, a working pressure sensitive adhesive surface which as adhered to a backing substrate, a backing film or paper and optionally a topcoat or surface treatment is applied to the backing on the opposite side of the pressure sensitive adhesive to enable printing and other similar finishing steps.

The backing material used in accordance with the inventive tamper evident reseal system comprises any known backing materials that are capable of being blown or cast into a transparent or semi-transparent continuous film. The backing material is substantially a two-dimensional object having a first and second side. By substantially two-dimensional, it is meant an object having a significantly large size measurement in two dimensions compared to a significantly small size measurement in the third dimension. Some particularly suitable backing materials include polymers, including, but not limited to polyethylene terephthalate, polyethylene, polypropylene; copolymers such as poly ethylene-propylene, polyethylene-octene, olefinic block copolymers and poly styrene films. The thickness of the backing will vary according to the particular application. The polymer backing may have a matte or glossy finish as well as a smooth or irregular (e.g., embossed) surface depending on the package it is being applied to. The film backing materials may be prepared utilizing either a single layer or multiple layer comprised of different compositions of the above backing listed polymers. Examples of multi-layer and compositional blends are disclosed in European Patent Number 2 049 333 B1, US Patent 20120060997 A1 and U.S. Pat. No. 5,585,193 A and are hereby incorporated as reference in their entirety as additional suitable backing substrates. Highlighted in U.S. Pat. No. 9,676,532 and in these reference patents are the advantages imparted by Machine Direction Oriented films (MDO) which can be utilized as the backing material for the reseal label structure of this invention. Similarly, as described specifically in the above referenced patent (U.S. Pat. No. 9,676,532) MDO films could be more advantageous over conventional films in this novel reclose package as the opening feature described below is opened directionally from the reseal label tab in the same machine direction of the film making it less likely to propagate a film tear upon opening and on repeated use in this novel tamper evident resealable package.

The adhesive used in the pressure sensitive coating may comprise any known adhesive. Preferred pressure-sensitive adhesives include formulated hot melt block copolymer adhesives, aqueous acrylic adhesives, solvent acrylic and rubber adhesives, and silicone adhesives. The adhesive can be applied as a continuous layer, or a discontinuous pattern on the backing. When the adhesive is applied as a coating, the coating weight of the adhesive will depend on such factors as the adhesive used, the backing material used, and the end application. Those skilled in the art will readily be able to determine a coating and coat weight. In accordance with the present invention, the adhesive is generally chosen such that after initial opening at the pull tab location a greater force is required to remove the adhesive from the attached objects than is required to separate the fastening system along the tear-open tamper evident novel cut design of this invention to create the opening to the package contents. In addition, the adhesive must reseal onto the package surface multiple times while not leaving any adhesive residues on the surface of the package to which it is separated from and reapplied to the package. Those skilled in the art will readily be able to determine a suitable pressure sensitive adhesive based on the packaging film and package contents in accordance with the end use application. Suitable examples of pressure sensitive adhesives for use in this novel reclose are disclosed in U.S. Pat. No. 9,676,532 and can be used in both dry and moist package contents. The reseal adhesive does not necessarily have to be resistant to alcohol, but can be depending on the package content.

To best utilize the novel series of arcuate cuts of the invention, a central pull-tab portion at the top of the resealable tape or label is adhesively deadened to facilitate manual grasping by the user so that the covering resealable pressure sensitive tape or label can be pulled downward. Although this grasp point creates radial lines of force on the package front away from the central grasp point, the arcuate cuts transfer these forces more directly to the frangible areas between the cuts so that uncontrollable tearing of the package is avoided. This is not the case with a simple series of linear dotted or dashed slits or perforations. Those types of cuts are only useable when the opening force is applied in the direction of the slits.

By the above package construction, even a light weight, inexpensive, polypropylene material can be used which has been treated with a pressure sensitive adhesive coating. The resealable feature can even be supplied by a simple wrap-around covering resealable transparent adhesive tape which makes the manufacture of the package, usually a flexible pouch or bag, very easy and inexpensive.

It is therefore an object of the invention to devise a tamper-evident package of light weight material that has a central tear-open closure which tears controllably. Other objects and advantages will be apparent from the following drawings and description of one embodiment of the invention.

DESCRIPTION OF THE PREFERRED EMBODIMENTS

Figure 1:
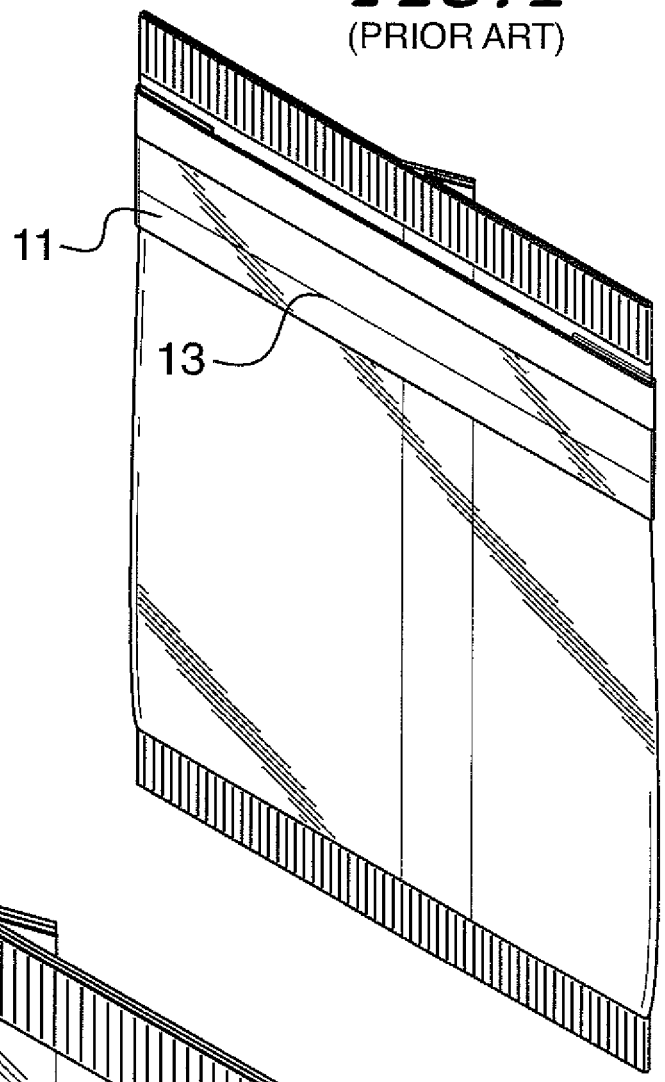
FIG. 1 (PRIOR ART)
FIGS. 1 and 2 are top right front isometric views of prior art packaging.
Figure 2:
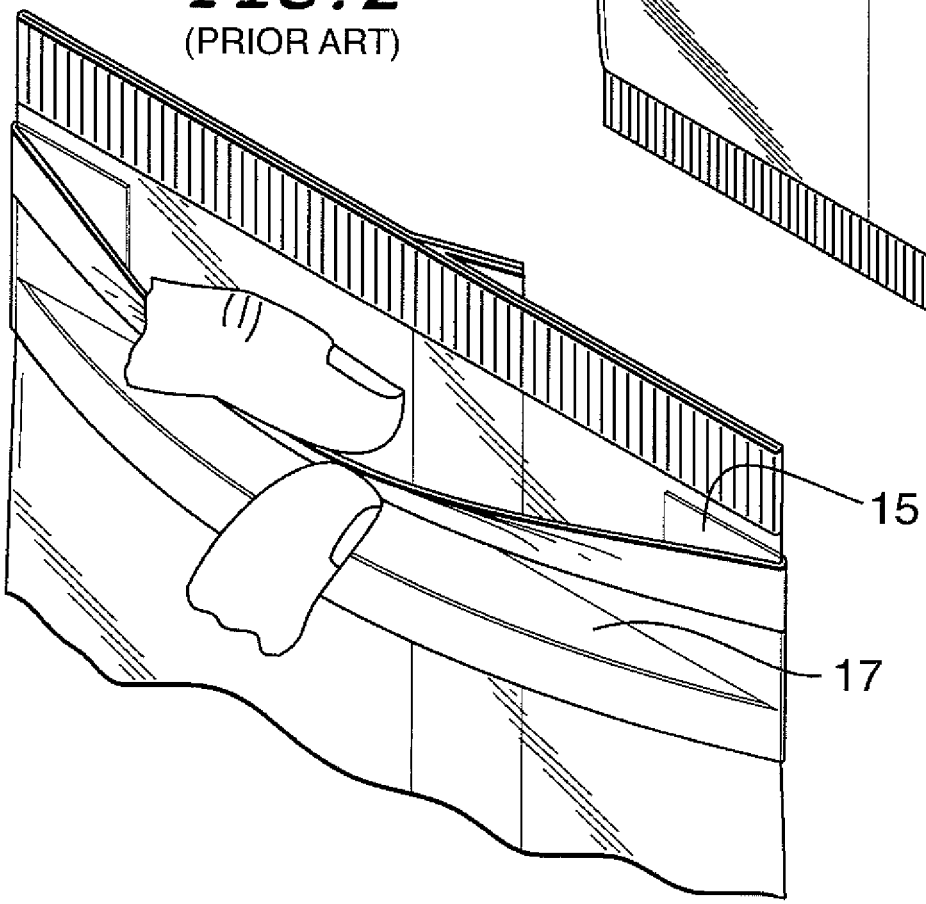
FIG. 2 (PRIOR ART)
Figure 3:
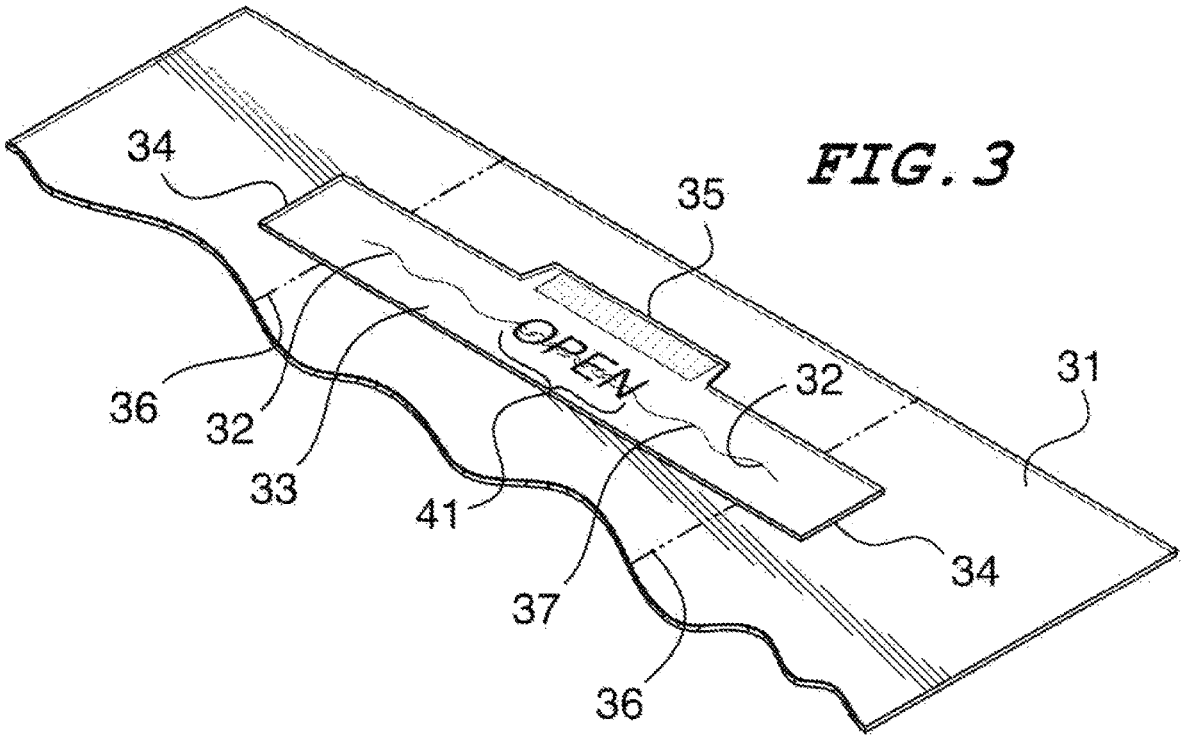
FIG. 3 is a top right front view of a preconstruction layout of one embodiment of the invention.

As defined herein the terms "upward", "downward" and "longitudinal" define the direction between the top and bottom edges of the package and the terms "lateral" and "laterally" define the direction extending between the opposing sides of the package. Referring now to FIG. 3, a pre-construction layout of the elements of one embodiment of the invention is shown. Film 31 has a piece of transparent pressure sensitive adhesive reseal structure 33 affixed across it extending laterally. The adhesive structure includes a pull tab 35 projects upward from the main body of the pressure sensitive reseal feature. The adhesive on the backside of the pull tab 35 is deadened so that it may be easily grasped by the user. The pressure sensitive adhesive reseal structure 33 extends laterally beyond fold lines 36 which define the sides of the package when constructed so that end portions 34 of the adhesive reseal structure 33 wrap around the sides of the package and the side of the structure which is coated with a pressure sensitive adhesive attaches to the back when fully formed for stronger attachment. The reseal structure may be a label or a tape composed of a polymeric backing and a pressure sensitive adhesive on either side of the backing.

Figure 8:
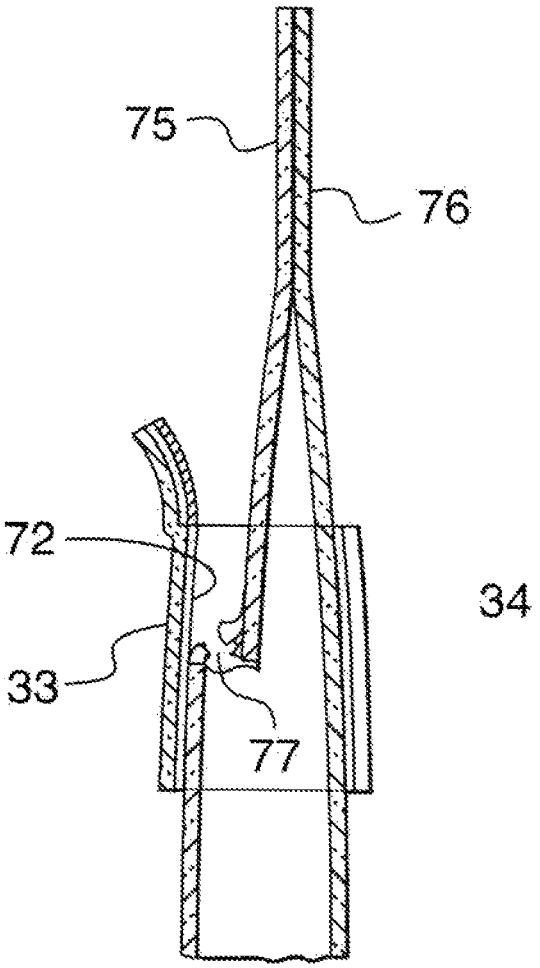

Beneath the adhesive reseal structure 33 in the center of the film between the side fold lines 36 a series of slits 37 and cuts 41 define a closure 32 in the closed position and which provides a package opening through which contents of the package can be removed when portions of the package front are separated along the slits and cuts and the closure is in an open position as seen in FIG. 8. The closure 32 comprises right and left side wavy slits 37 and a series of arcuate cuts 41 in the center. For reasons later described, the film preferably has a printed-on graphic such as the word "OPEN" in the area of the arcuate cuts seen in this figure.

Figure 4:
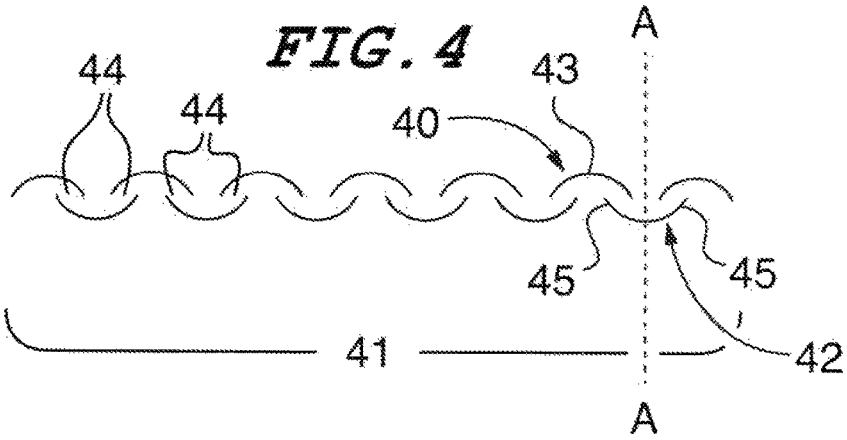
FIG. 4 is a close-up view of the tear-open cut pattern.
Figure 6:
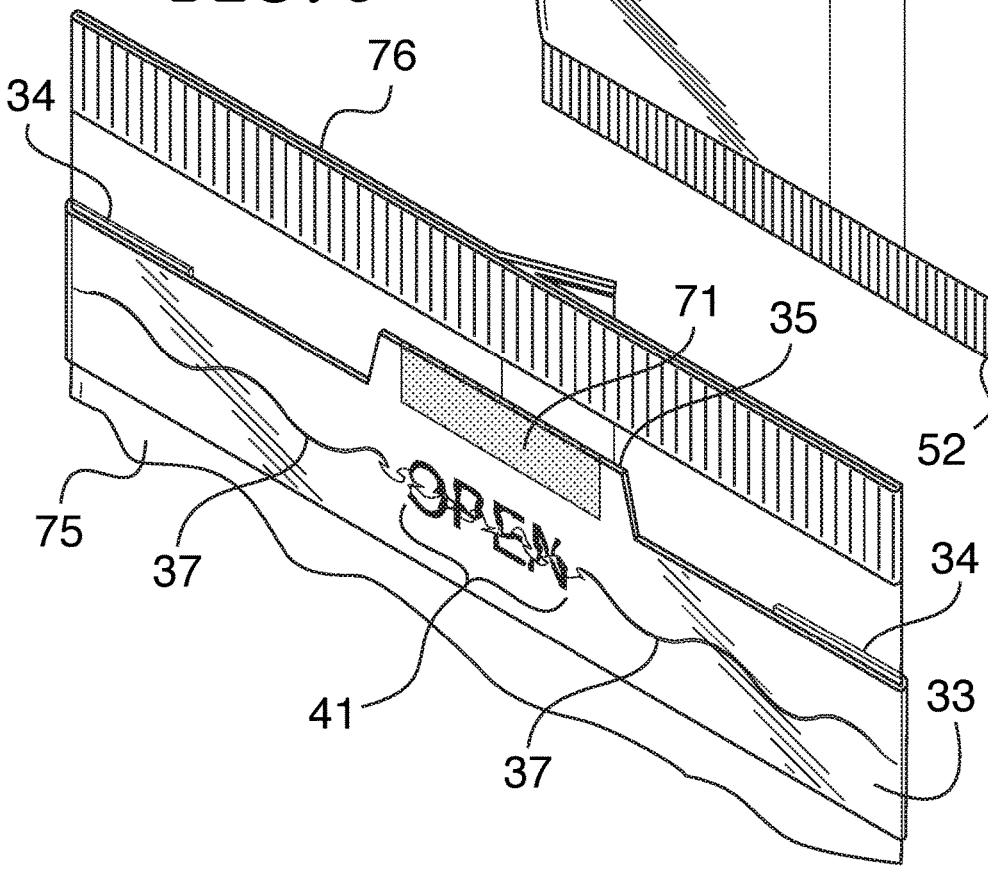

Referring to FIG. 4, the pattern of the series of arcuate cuts 41 that lies in the area of the printed word "OPEN" seen in FIGS. 3, 4, and 6 is shown. The series of cuts 41 comprise two laterally extending longitudinally spaced opposite facing rows of individual identical arcuate cuts. Here we see that each arcuate cut such as cuts 40 and 42 has a facing direction defined by the pointing direction of its apex. The cuts are longitudinally staggered and alternate in upward and then downward pointing directions of their respective apexes. One exemplary longitudinal axis of cut 42 is shown as A-A. The cuts in the series 41 are substantially identical and are geometrically symmetrical about their axis. Frangible portions 44 of the package front are located between adjacent cuts.

Figure 5:
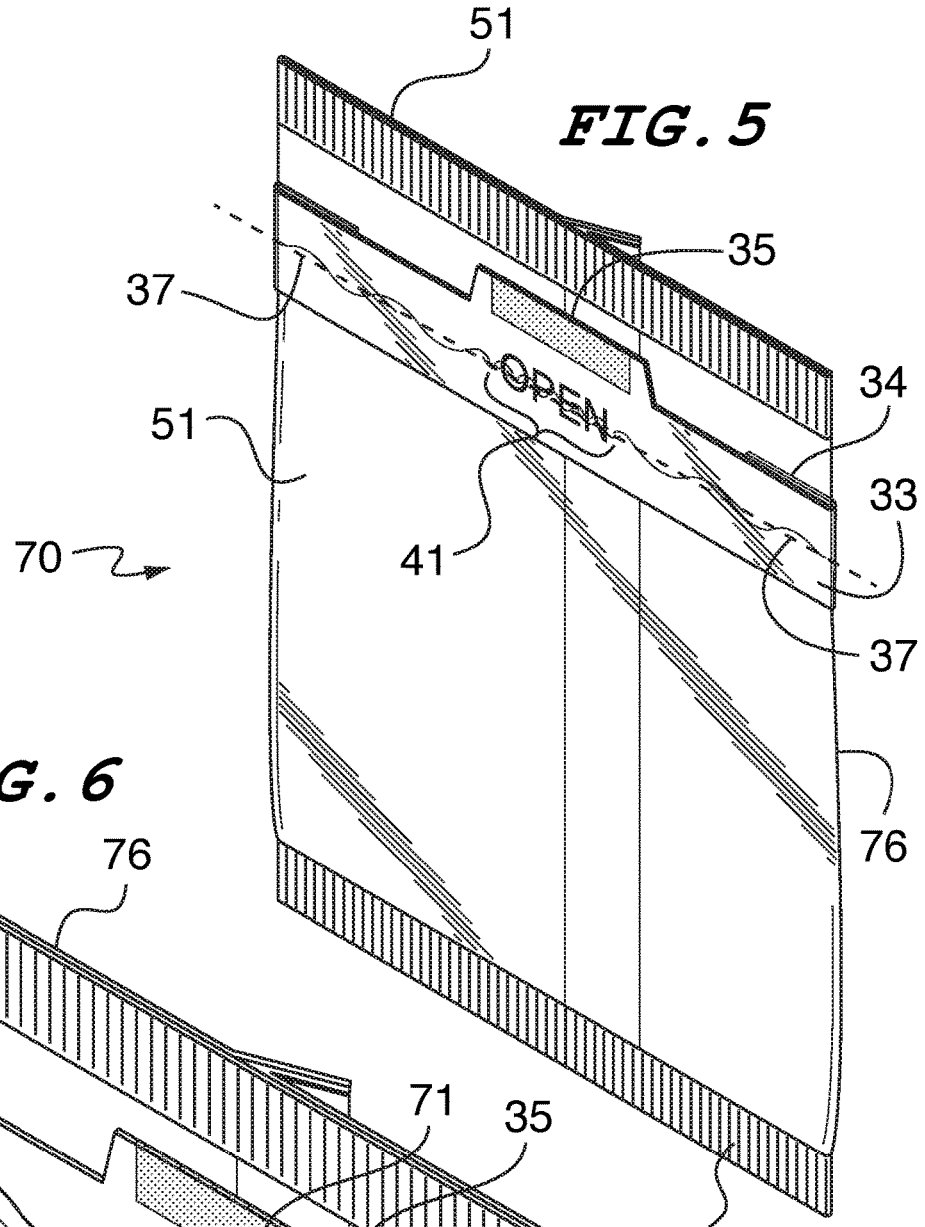
FIGS. 5 and 6 are top right front isometric views showing a package of the invention before and after the first package opening.

Referring now to FIGS. 5 and 6, we see depictions of the package constructed from the layout show in FIG. 3 before and after it is first opened respectively. The package 70 has top and bottom edges 51 and 52 and a front 75 and a back 76. When first opened, the user pulls tab 35 having adhesive deadening material 71 tearing the package material of the front 75 of the package apart that resides between adjacent cuts of the centrally located series of arcuate cuts 41. The attachment of the adhesive reseal structure 33 such as a tape or a label is strengthened by portions 34 which wrap around to the back side of the package 76 as more clearly seen in FIGS. 7 and 8. Other portions of the package front are non-destructively separated along the continuous wavy slits 37 on either side of the arcuate cut series. This provides the reclosable opening in the package as seen in FIG. 8 necessary to access its contents. In FIG. 6 we see the package reclosed and resealed. Here, the manually frangible portions of the package front located between adjacent cuts of cut series 41 are torn apart around and through the printed word "OPEN" which when resealed distorts its depiction so that the act of prior package opening is visibly evident through the transparent adhesive reseal structure 33. Because only a small portion of the closure needs to be forcibly torn, only a relatively small force is needed. This, in combination with the novel shape of the cuts, permits the desirable use of a lighter gage film material and a package that is easier to open.

Figure 7:
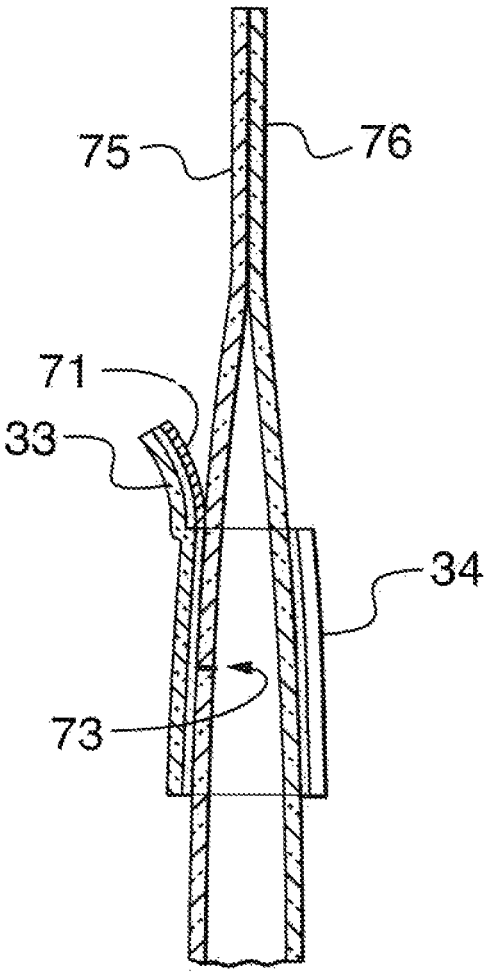
FIGS. 7 and 8 are right side sectional views of the package of the invention in the closed and open positions respectively.

The opening process is further depicted in FIGS. 7 and 8. As seen in FIG. 7 the constructed package forms front and back panels 75 and 76. Pull tab 35 has deadening material 71 applied to its back surface to allow manual grasping. With the tear open closure in the closed position, the main body of the adhesive structure 33 which is preferably a resealable transparent adhesive structure having adhesive 72 covers the various closure slits and cuts shown here as cut 73. Side portions 34 of the reseal structure 33 wrap around and are adhered to the back 76 of the package 70. As the tab is grasped and pulled downward the adhesive structure 33 starts to peal from the front panel 75. When the separation point of the peal crosses the above described series of arcuate cuts the adherence of the reseal structure either a tape or pressure sensitive label to the panel just below the cuts is sufficient to tear the panel material between the cuts to create a package opening through which its contents can be removed. FIG. 8 shows the package of FIGS. 3-7 in its open condition with the tear open closure moved to the open position. Here we see the material of the package front panel 75 destructively torn apart at the mouth of the opening 77 between separated parts of the front panel.

From the above description of the invention it can readily be seen that the objects of the invention have been achieved. While only one embodiment of the invention is depicted in the drawings and described above there can be variations in dimension and proportionality. Furthermore the means of production can be any suitable means available to the art at that time.

Many modifications to the preferred embodiment may be possible without departing from the scope and spirit of the invention which shall be defined only by the following claims and their legal equivalents.

The invention claimed is:

1. A package, comprising;

a package having a front, a back, and top and bottom edges defining upward and downward longitudinal directions, said package also having opposing left and right side edges defining a lateral direction;

a laterally extending tear-open closure for opening and closing the package moveable from an open position to a closed position for providing access to contents within the package through the closure when open, said closure having a series of arcuate cuts comprising two laterally extending longitudinally spaced rows of individual unconnected arcuate cuts, each cut defining a continuous arc with an apex and two free ends;

a transparent adhesive structure for holding the closure in the closed position;

wavy slits through the package front on either later side of the series of arcuate cuts, all being part of the closure; and graphics printed on the package front in the area of the series of arcuate cuts to enhance the visual evidence of the closure being previously opened.

2. The package of claim 1 wherein a facing direction of each of said cuts is defined by the pointing direction of its apex and wherein the cuts of one row all point in one longitudinal direction opposite the pointing direction of all the cuts of the other row, said rows being longitudinally staggered thereby defining a series of laterally extending alternating upward pointing and then downward pointing unconnected cuts.

3. The package of claim 2 wherein the ends of longitudinally adjacent cuts overlap.

4. The package of claim 1 having manually frangible portions of the package front located between adjacent cuts which rupture when the package is first opened.

5. The package of claim 1 wherein a prior opening of the package closure is evident after it is closed and resealed by the adhesive structure.

6. The package of claim 4 wherein the series of cuts are centered between opposite sides of the package.

7. The package of claim 1 wherein a central longitudinally extending tab portion of the adhesive structure is adhesively deadened to facilitate its manual grasping.

8. The package of claim 7 wherein the adhesive structure is located across the package front, wraps around the sides of the package, and is adhered to a back side.

9. The package of claim 1 wherein the cuts are substantially identical except for their orientation.

10. The package of claim 9 wherein the cuts each have a longitudinal axis.

11. The package of claim 9 wherein the longitudinal axes of the series of arcuate cuts are parallel.

12. The package of claim 9 wherein each arcuate cut is symmetrical about its longitudinal axis.

13. The package of claim 12 wherein the adhesive structure is adapted to function equally well with either moist or dry package contents.

* * * * *